US005083598A

United States Patent [19]

Schön

[11] Patent Number: 5,083,598

[45] Date of Patent: Jan. 28, 1992

[54] ELECTROMOTIVELY DRIVEN SUNBLIND

[75] Inventor: Siegfried J. Schön, Etten-Leur, Netherlands

[73] Assignee: Schon B.V., Breda, Netherlands

[21] Appl. No.: 702,459

[22] Filed: May 17, 1991

Related U.S. Application Data

[63] Continuation of Ser. No. 407,367, Sep. 14, 1989, abandoned.

[30] Foreign Application Priority Data

Sep. 16, 1988 [NL] Netherlands ..... 8802303

[51] Int. Cl.[5] ..... E06B 3/94

[52] U.S. Cl. ..... 160/84.1; 160/279

[58] Field of Search ..... 160/84.1, 310, 107, 160/321, 279, 243

[56] References Cited

U.S. PATENT DOCUMENTS

| | | | |
|---|---|---|---|
| 2,179,763 | 11/1939 | Smolowitz . | |
| 3,253,644 | 5/1966 | Gotoh et al. | 160/107 |
| 4,679,610 | 7/1987 | Spraggins | 160/84.1 X |
| 4,683,933 | 8/1987 | Dunbar | 160/84.1 X |
| 4,685,502 | 8/1987 | Spangenberg | 160/107 |
| 4,718,471 | 1/1988 | Kraeutler | 160/84.1 |
| 4,723,586 | 2/1988 | Spangenberg | 160/107 |
| 4,733,711 | 3/1988 | Schon . | |
| 4,813,468 | 3/1989 | Fraser | 160/84.1 |
| 4,817,698 | 4/1989 | Rossini et al. | 160/107 |
| 4,850,414 | 7/1989 | Lessard | 160/84.1 |
| 4,850,415 | 7/1989 | Rometsch | 160/84.1 |
| 4,852,627 | 8/1989 | Peterson et al. | 160/84.1 |

FOREIGN PATENT DOCUMENTS

| | | |
|---|---|---|
| 3302529 | 7/1984 | Fed. Rep. of Germany . |
| 8807605 | 6/1988 | Fed. Rep. of Germany . |
| 3700745 | 7/1988 | Fed. Rep. of Germany . |
| 6616830 | 5/1968 | Netherlands . |

*Primary Examiner*—David M. Purol

*Attorney, Agent, or Firm*—Wegner, Cantor, Mueller & Player

[57] ABSTRACT

An electromotively driven sunblind includes a first beam and a second beam which are movable in parallel relative to each other. A motor and a drive shaft having at least one drive roller are disposed within a hollow cavity in the first beam and relative movement of the second beam is effected by at least one flexible operating element. A screen is disposed between the first beam and the second beam which may be of a pleated material.

14 Claims, 8 Drawing Sheets

FIG. 10
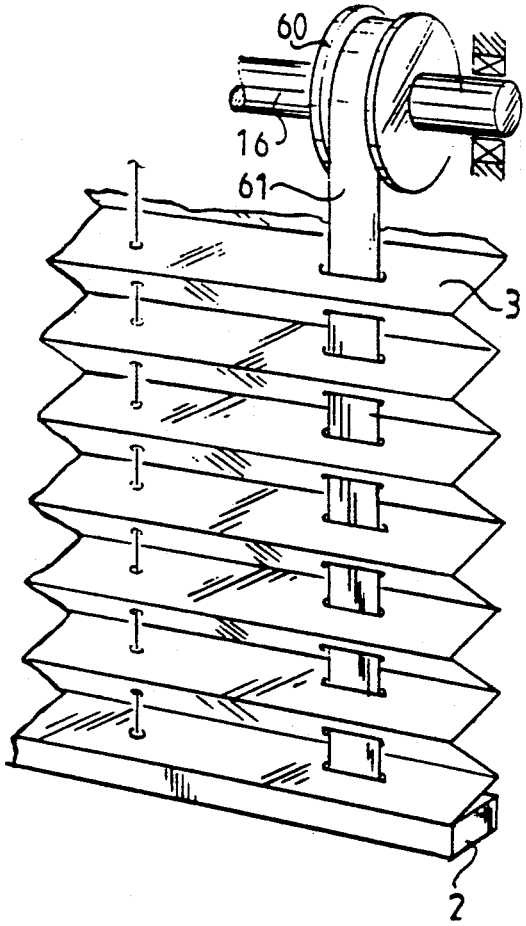
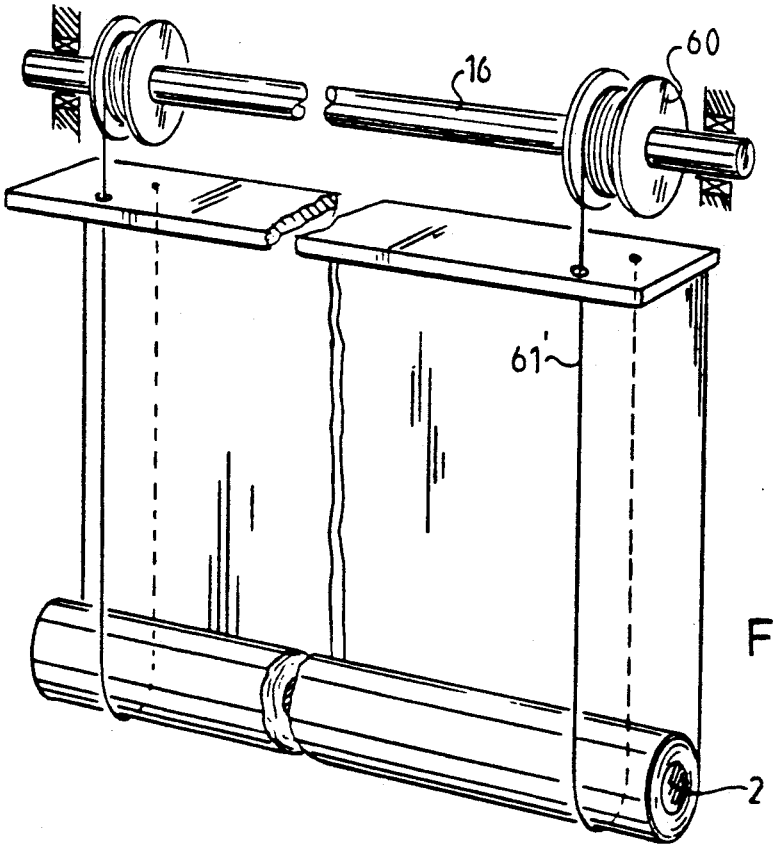
FIG. 11

ELECTROMOTIVELY DRIVEN SUNBLIND

This application is a continuation of U.S. application Ser. No. 07/407,367, filed Sept. 14, 1989, now abandoned.

BACKGROUND OF THE INVENTION

The invention relates to a sunblind having a first beam and a second beam which are movable toward and away from one another by means of a flexible operating element whereby between the first and second beam a screen of random nature is arranged.

Sunblinds of the type described above are known in various embodiments, mainly through the difference in the type of screen. One can envisage here a pleated screen, a flat screen which can be rolled up around the freely suspended lower beam, a venetian blind and the like. Such sunblinds are usually manually operated, that is, that a flexible operating element is manually tightened or loosened in order to close off the window opening to a greater or lesser degree. This manual operation is made more difficult the larger the opening to be closed off becomes the and when one or more sunblinds are hung next to each other. Furthermore it is difficult to close off the opening in good time since control cannot be performed automatically. Solutions have already been proposed for the use of a motor drive but these encounter installation and aesthetic problems (large dimensions).

SUMMARY OF THE INVENTION

The invention has for its object to provide a sunblind of the type described above whereby the abovementioned objections are overcome.

The sunblind according to the invention is distinguished in that each operating element is trained around a motor driven roller mounted for rotation in or on the first beam. Use of the motor driven roller means that the operating elements normally directed to one side of the window opening are no longer necessary, which furthers the controllability and enhances the appearance of the sunblind.

In one embodiment the roller is embodied as a reel whereby the second beam is freely suspended on two or more flexible operating elements. Force of gravity provides resetting when the operating elements are loosened, while in another drive direction the sunblind can be raised.

In another embodiment the roller is a toothed wheel over which is trained a flexible belt with co-acting cutaway parts. A sunblind embodiment can be hereby applied which need not necessarily be vertically situated.

In another embodiment the belt takes an endless form whereby the option is acquired of arranging screens for a single window opening that are movable toward and away from one another.

For the further embellishment of the sunblind the first beam takes a hollow form for the accommodation of an electro-tube motor and the associated drive shaft for one or more drive rollers, said drive shaft being continuous over the length of said beam. In order to obtain a simple construction the tube motor is preferably mounted at either end in a bearing block which serves for bearing mounting of the drive shaft with the drive rollers.

According to the invention the block is preferably a plastic injection-moulded article provided with assembly lips for easy fitting in the hollow first beam.

It is thereby recommended to manufacture the beam from at least two uniform dish profiles, each of which are provided with an inward-facing ridge around which in each case a pair of lips of the bearing block can grip.

This considerably simplifies the fitting of the upper beam.

The invention is elucidated further in the figure description below of a number of embodiments.

BRIEF DESCRIPTION OF THE DRAWINGS

FIG. 10 shows a perspective view of a fourth variant of the drive system of a sunblind, FIG. 11 is a view corresponding with FIG. 10 of a fifth variant of a drive for a roller blind.

DETAILED DESCRIPTION

Figure 1:
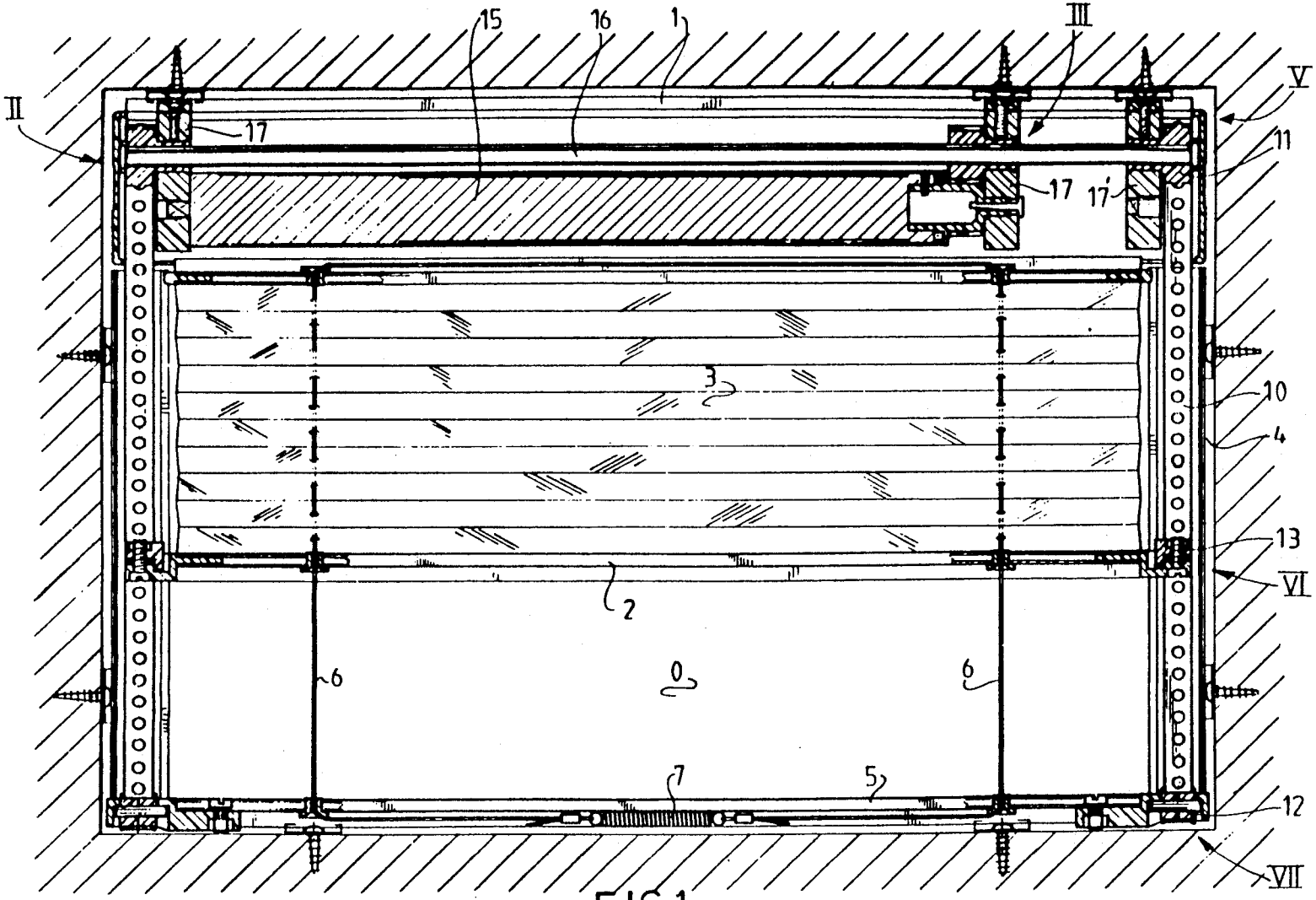
FIG. 1 shows a front view of a window-opening provided with a sunblind in the form of pleated material provided with a drive system according to the invention.

Shown in FIG. 1 is a window opening O which can be screened off by means of a sunblind. To this end a first beam 1 is arranged at the top of the window opening and a second beam 2 is up and downwardly movable relative to that beam. Between both beams is arranged a screen in the form of pleated material 3. For the up and downward movement of the second beam in this embodiment a guiding and drive system is arranged which will be further elucidated below.

Placed along the standing sides of the window opening 0 is a guide profile 4 which is connected at the bottom with a fixed lower profile 5 so that together with the first beam a framework results. Between the first upper beam and the lower profile 5 are arranged guide cords 6 which are mutually coupled by means of a tension spring 7. In this way the second beam 2 as well as the webs of the pleated material are guided, the latter being provided with appropriate passage openings for the cord 6. This in itself is a known guiding mechanism and falls outside the scope of the invention.

Arranged in the side profile 4 is a belt-like flexible drive element 10 which is trained at the top around a toothed roller 11 and at the bottom around a return roller 12. The belt is connected to the second beam 2 at 13. Through the driving of the toothed roller 11 the endless belt 10 can be moved, carrying with it the second beam 2.

According to a feature of the invention the first beam 1 has a hollow form and comprises an electro-tube motor 15 and a drive shaft 16 extending along the entire length of the first beam. The drive shaft 16 is mounted in bearing blocks 17 which also serve as bearings for both ends of the tube motor 15. A third bearing block 17' is accommodated on the right in the beam 1 in order to serve as a bearing for the toothed roller 11. A similar construction is applied on the left in the beam 1.

Figure 2:
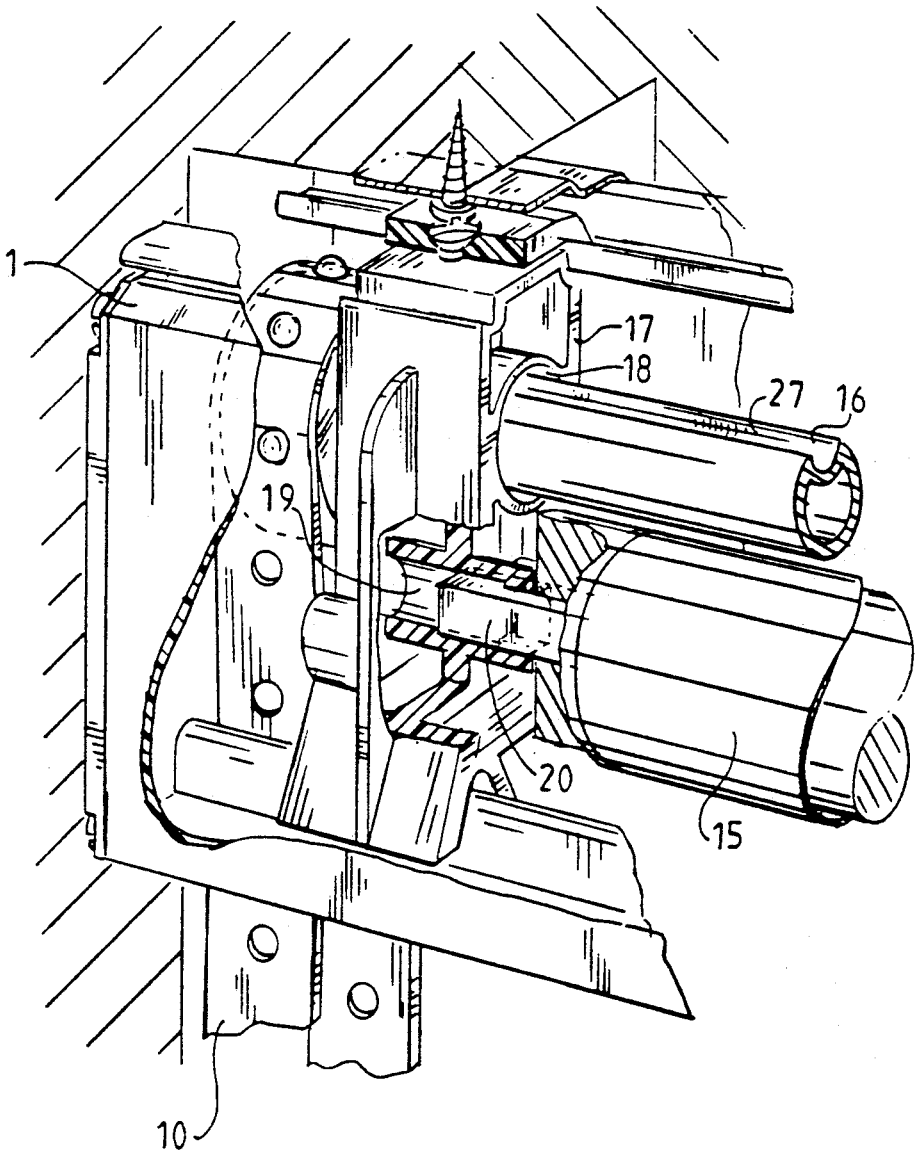
FIG. 2 shows a perspective view according to the arrow II in FIG. 1 of a part of the bearing mounting of the electro-tube motor employed therein with drive shaft and drive roller.

For a further description reference is made to FIG. 2 in which it can be seen that the bearing block 17 is embodied as a plastic injection-moulded article with an uppermost passage opening 18 for the drive shaft 16. It should be noted that in the bottom passage opening 19 along a portion of its length the cross section is circular and along a portion it has a square cross section. The square cross section serves for the accommodation of a square end pin 20 of the tube motor 15. The housing of the tube motor is hereby non-rotatably mounted in the bearing block 17 in order to be able to set in rotation the drive toothed wheel 21 arranged at the other end of the tube motor 15 without rotation of the tube motor itself, see also FIGS. 3 and 4. The rotation is possible because the toothed wheel 21 has a shaft stub 22 which fits into the cylindrical portion of the bottom passage opening 19 of the bearing block 17. A locking pin 23 serves to lock the shaft stub 22 in this passage opening 19.

The top passage opening 18 is dimensioned such that a sleeve 25 fits in a toothed wheel 24 that engages with toothed wheel 21 of the tube motor, which sleeve is provided with resilient lips 26 situated diametrically opposite one another which display a hook-shaped end and which after the insertion of the sleeve 25 into the opening 18 grip behind the end surface of the bearing block lying opposite the toothed wheel 24. In this manner the toothed wheel 24 can rotate in the bearing block without being axially slidable. Each toothed wheel 24 is provided with an internal key which falls into a continuous groove 27 of the drive shaft 16. It will be apparent from the above that when the tube motor is energised the toothed wheel 21 will start to rotate in the one or other rotation direction, resulting in the toothed wheel 24 being carried with it in the opposing rotational direction. Because of the key-groove connection the drive shaft 16 will be able to start rotating in the bearing blocks 17.

Figure 5:
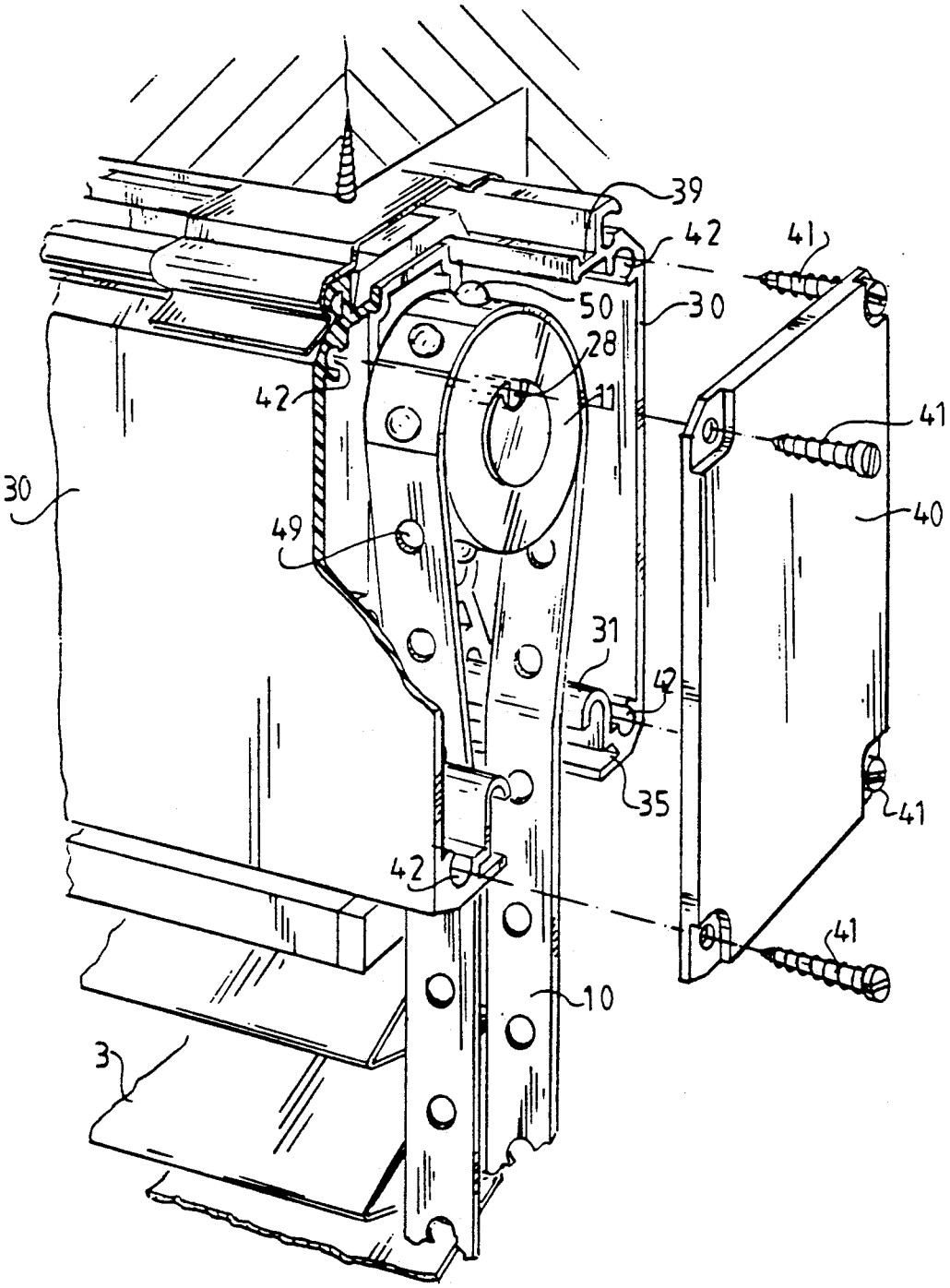
FIG. 5 is a perspective view according to the line V in FIG. 1 of the toothed roller with a flexible operating element trained around it.

As already stated, both ends of the drive shaft 16 are provided with a toothed roller 11 which is provided with a sleeve 25 in a similar manner to the toothed wheel 24 and which fits into the passage opening 18, see FIG. 5. Here too a key 28 is arranged which fits into the groove 27 of the drive shaft 16 so that when the drive shaft 16 is turned the toothed roller will start to turn relative to the bearing block 17.

In the case that the window opening O is very wide the through-running drive shaft 16 can be supported at regular intervals by a bearing block 17, thus ensuring an uninterrupted rotation of the drive shaft 16.

Figure 3:
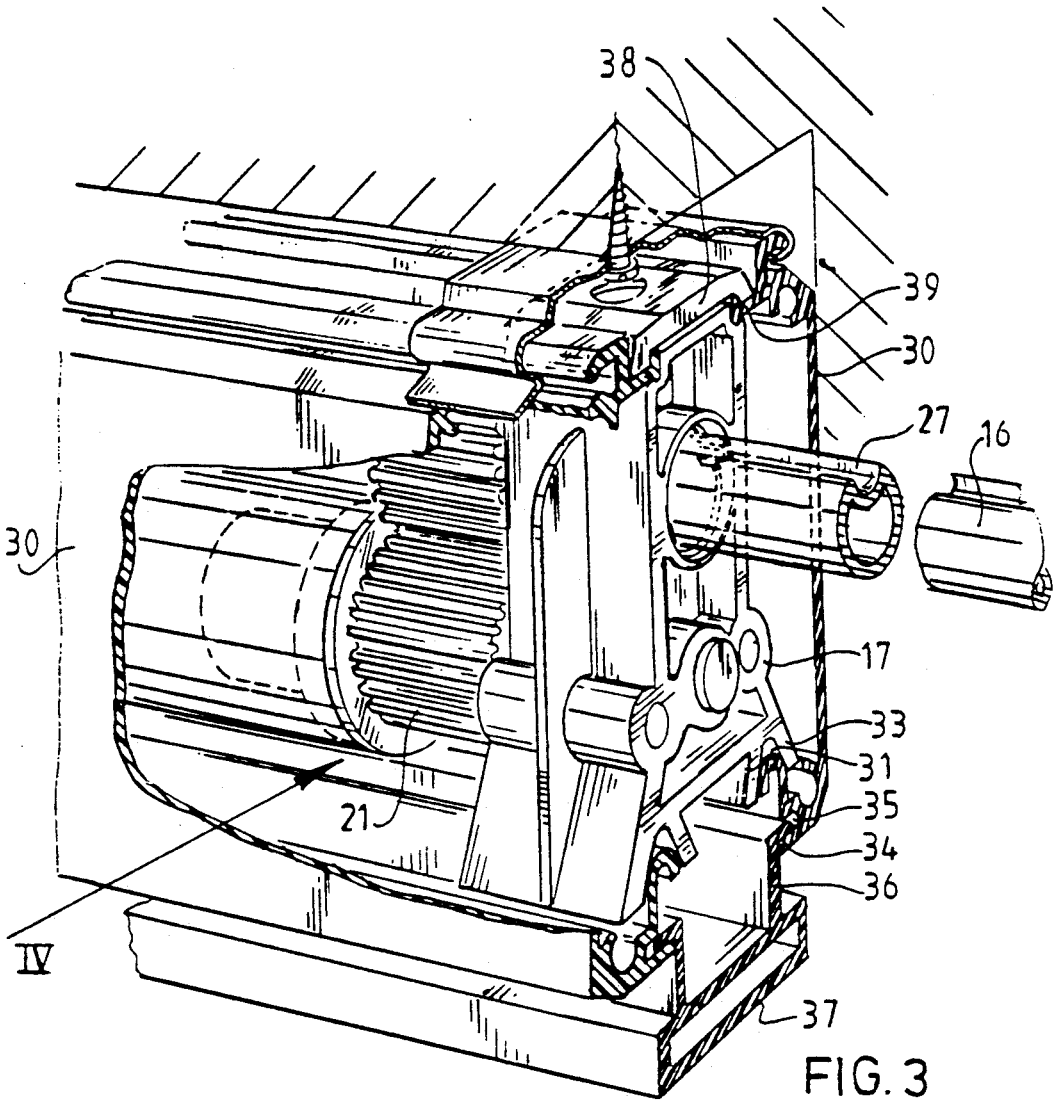
FIG. 3 shows a perspective view according to the arrow III in FIG. 1 of the other bearing side of the electro-tube motor.
Figure 4:
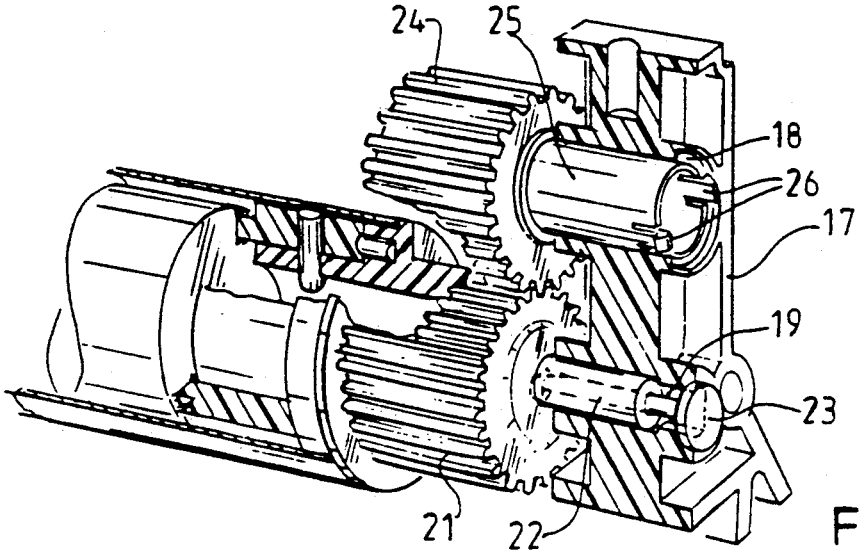
FIG. 4 shows a perspective view according to the arrow IV in FIG. 3 of a part of the transmission.

As is shown in FIGS. 3 and 5 the upper beam 1 consists of at least two dish-shaped parts 30 which are uniform. The dish-shaped parts are formed on the underside with an inward protruding rib 31 onto which fit each pair of lips 33 of each bearing block 17. In addition each dish is embodied with an inward pointing flange 34 which together with the foot of the rib 33 form a groove 35. The groove 35 serves to receive an L-shaped leg 36 of a lower profile 37, which serves for the attachment of the screen 3. The bottom profile 37 forms together with the dishes 30 the hollow first beam 1 when these are assembled using the bearing blocks 17 and by means of the closing plate 38 which is has a U-shaped form, the legs of which fall into a lengthwise groove 39 of each respective dish 30.

Owing to the profile-shaped structure of the bearing dishes the bearing blocks 17 with the accompanying closing plate 38 can be arranged at random locations along the length thereof. This enables optimal assembly and support of the tube motor 15 and the drive shaft 16 with the associated drive rollers, whereby it is noted that the drive rollers can be arranged in the position where the required flexible operating element for the relevant screen of the sunblind is necessary.

It is finally noted that if required the upper beam can be closed off with an end plate 40 which can be screwed by means of screws 41 into open circular channels 42.

Figure 6:
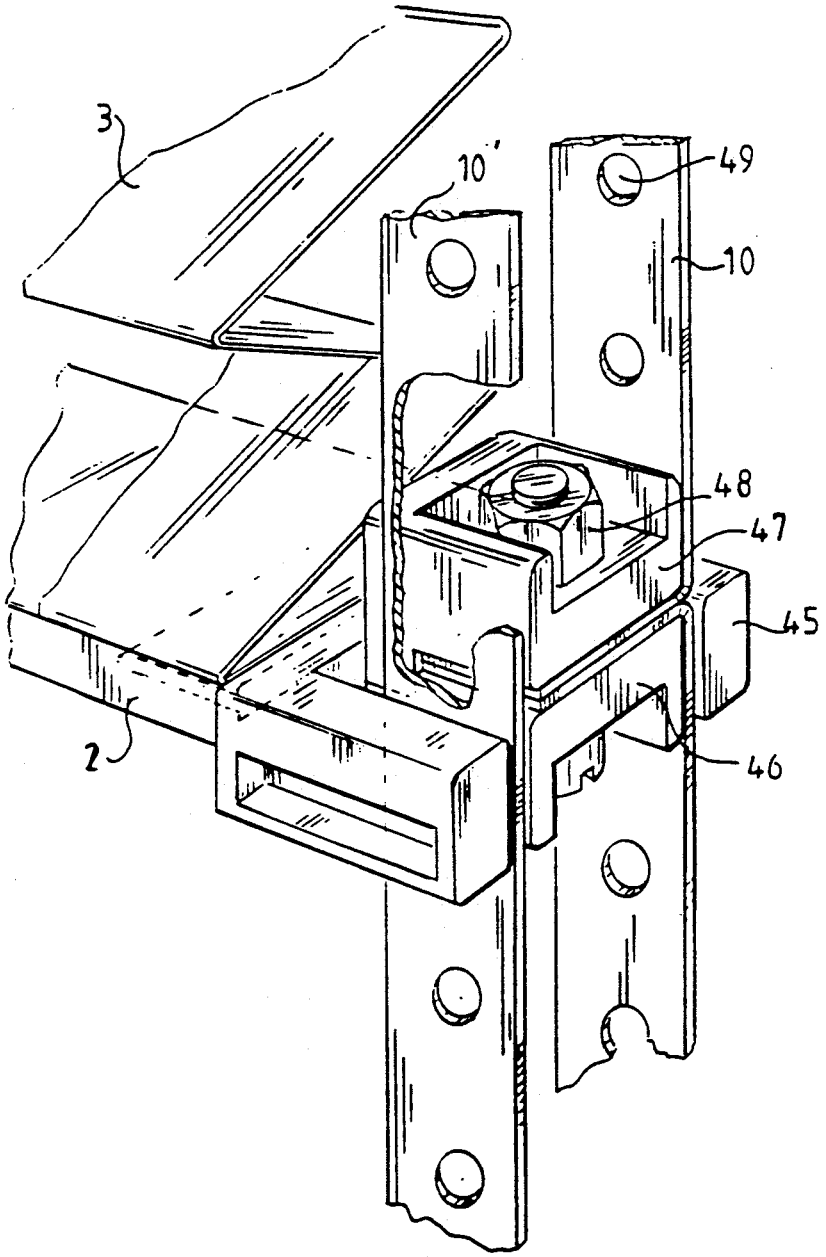
FIG. 6 shows a perspective view of the attachment of the second beam to the flexible operating element.

The second beam 2 can be fixed by the construction shown in FIG. 6 to the flexible drive element 10 by a clamp construction consisting of a fork-like end 45 of the lower beam 2 in which is fixed a bottom clamping member 46. The end of the element 10 is clamped fixedly between the clamping member 46 and one leg of the fork 45. The other end of the element 10 is clamped fixedly to the upper side of the clamping member 46 by means of an upper clamping member 47 which is clamped in position thereon by means of a screw bolt attachment 48. The opposite part 10' of the flexible element can move freely between the other leg of the fork and the bottom clamping member 46.

The flexible element 10 is provided with cut-away parts 49 which are located at mutual intervals such that the teeth 50 arranged on the toothed roller 11 fall into these cut-away parts 49. A slip-free transmission between the toothed roller 11 and the belt 10 is hereby ensured.

Figure 7:
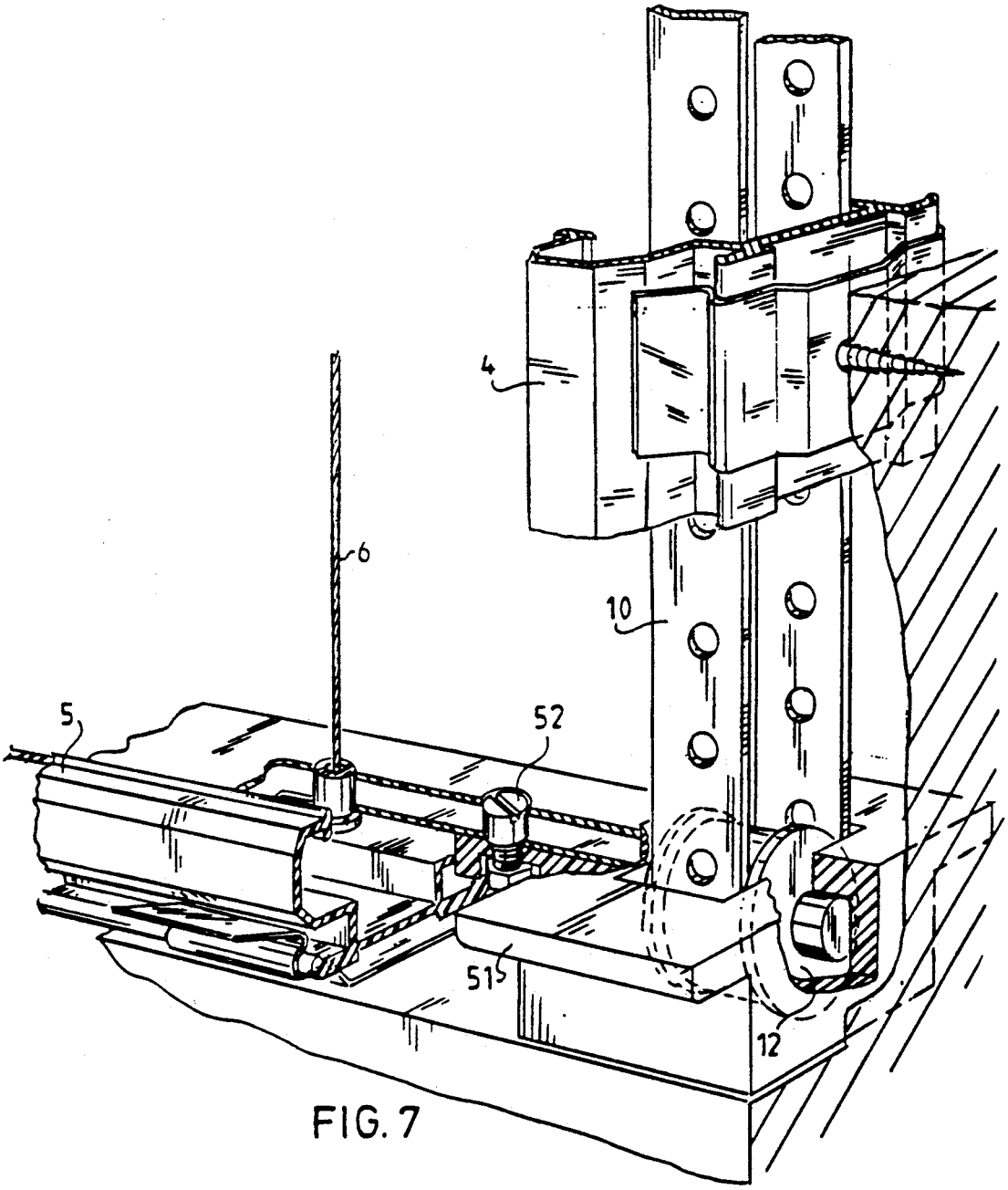
FIG. 7 is a perspective view according to the line VII in FIG. 1 of the reversing roller of the flexible operating element at the bottom of the window frame.

The element 10 is endless and is therefore embodied at the bottom of the window opening O with a reversing roller 12 which is rotatably mounted in an end piece 51 on the underside side of the side profile 4. This roller is toothless and serves purely to guide the element 10. The bottom element 51 also serves for fastening of the profile 5 by means of the screw bolts 52, see FIG. 7.

Figure 8:
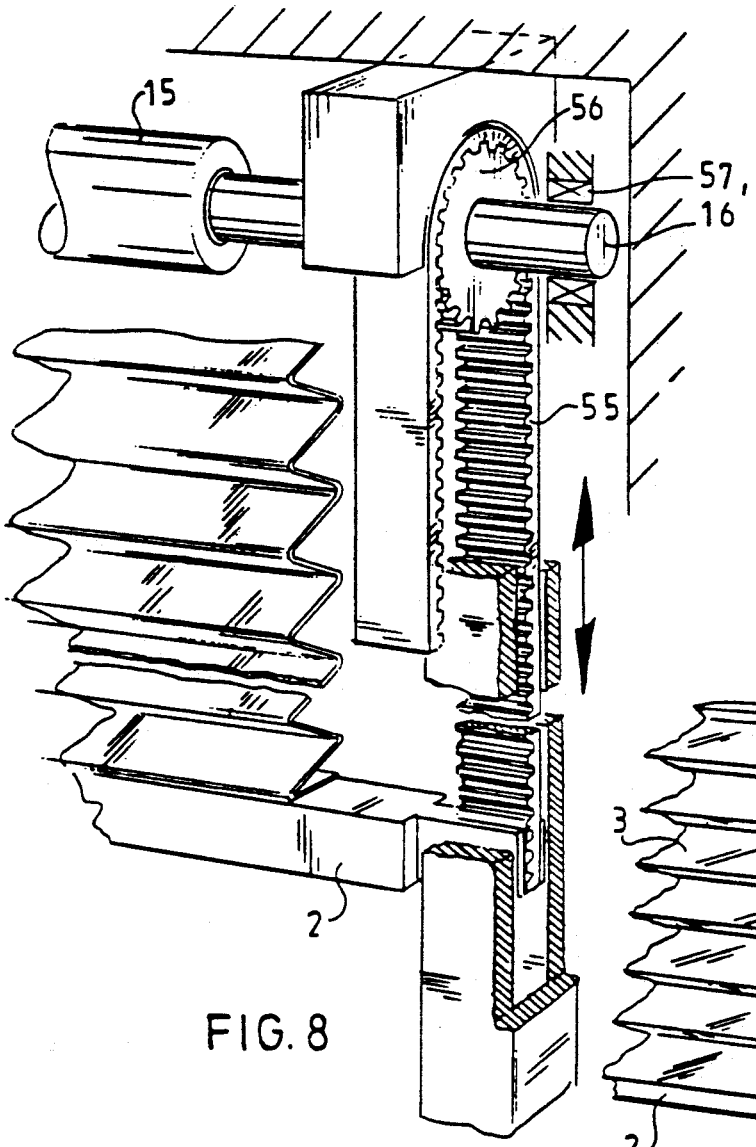
FIG. 8 is a perspective view corresponding with FIG. 5 of an alternative embodiment of the operating element.

FIG. 8 shows an alternative embodiment of a flexible drive element in the form of a toothed belt 55 which is routed around a toothed wheel 56. The toothed belt 55 is of a stiffness such that it does not need to be made as an endless element but a reciprocating rotation of the toothed wheel 56 provides an up and downward movement of one of the parts of the toothed belt 55 which is fixedly connected at the bottom end to the second beam 2.

The first beam (not shown) once again contains an electro-tube motor 15, of which the output shaft 16' serves directly as drive shaft. In the same or other suitable manner the toothed wheel 56 is non-rotatably connected thereto. The bearing mounting of the drive shaft 16' can take place in the manner described above or in another manner by means of a bearing 57.

The loose end of the toothed belt 55 can hang freely and is guided in the appropriate side guide 4 of the framework for the sunblind.

Figure 9:
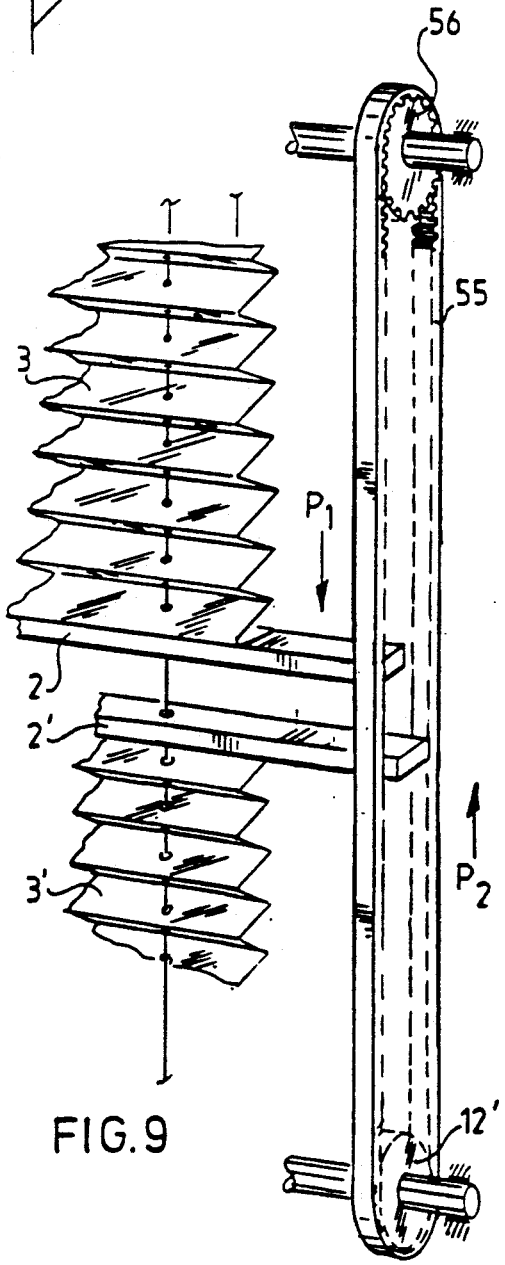
FIG. 9 shows a perspective view of a third embodiment of the flexible drive element suitable for two sunblind screens movable in opposition to one another.

FIG. 9 shows an alternative embodiment whereby the toothed belt 55 does take an endless form and is tensioned via a bottom reversing roller 12'. To the front part is attached a lower beam 2 of the upper sunblind screen 3 while to the rear part is attached a second beam 2', situated above this, of the opposite located screen 3' of the lower sunblind.

It will be apparent that by turning the drive roller 56 the endless belt 55 moves downward at the front side and upward at the rear side according to the respective arrows P1 and P2. As a result both second beams 2, 2' are moved toward one another. A rotation in the reverse direction of the drive roller 56 gives a reversed movement of the belt and therefore a movement of the two beams 2, 2' away from one another. In this way the window opening can be closed or opened by means of two screens.

FIG. 10 shows an embodiment whereby the drive shaft 16 from FIG. 1 is provided at regular intervals with a drive roller in the form of a reel 60 around which is trained a band 61. The band is fixed at the bottom end to the second beam 2 and is guided through openings in the webs of the pleated material 3 of the sunblind. The lower beam 2 hereby hangs down freely and may optionally be guided at the head-end in a runway 4 of the window frame, but this latter is not strictly necessary. The driving of the shaft 16 and therefore of the reel 60 is carried out in the manner described above by means of a tube motor 15 in a hollow upper beam 1. The band 61 is thereby wound onto the reel 60 to a greater or lesser extent in order to raise or lower the screen under the influence of the force of gravity.

FIG. 11 shows a fifth embodiment whereby in the manner of FIG. 10 the drive shaft 16 is provided with rollers in the form of a reel 60 around which is wound a cord 61'. The other end of the cord is attached in the bottom profile 37 of the hollow upper beam 1. In the downward hanging loop of the cord 61' is suspended the rollable lower beam 2, around which a sunblind in the form of a flexible screen can be rolled. The driving of the shaft 16 is performed in the manner described above with reference to FIGS. 1-5. A turning of the shaft 16 in the one direction results in a winding up of the cord 61' on the reel 60 and therefore a raising of the lower beam 2 and a rolling up of the screen 3. A turning in the other direction will cause the screen to roll down.

While there is shown and described present embodiments of the invention, it is to be distinctly understood that the invention is not limited thereto, but may be otherwise variously embodied and practiced within the scope of the following claims.

What is claimed is:

1. An electromotively driven sunblind comprising:

a first beam and a second beam movable in parallel with respect to each other, wherein said first beam is hollow;

a motor disposed within said first beam and having a motor shaft;

moving means for moving said first beam and said second beam relative to each other;

drive means driven by said motor and disposed parallel to said motor shaft for driving said moving means and comprising a drive shaft having two ends extending longitudinally in said first beam over the full length thereof and two drive rollers mounted on said drive shaft proximate the ends thereof, wherein said moving means comprises at least one flexible operating element trained around each of said drive rollers; and a screen arranged between said first beam, said second beam, and said flexible operating elements.

2. An electromotively driven sunblind as claimed in claim 1, wherein said at least one drive roller is a toothed wheel, and wherein said flexible operating element is a flexible belt with cut-away parts.

3. An electromotively driven sunblind as claimed in claim 2, wherein the flexible belt is endless.

4. An electromotively driven sunblind as claimed in claim 3, wherein two second beams are provided, and wherein both said second beams are connected to the flexible belt.

5. An electromotively driven sunblind as claimed in claim 1, wherein said motor is mounted in a bearing block, and wherein said bearing block supports said drive shaft.

6. An electromotively driven sunblind as claimed in claim 5, wherein the bearing block is injection-molded and comprises mounting lips.

7. An electromotively driven sunblind as claimed in claim 5, wherein the first beam comprises two uniform dish-shaped parts, wherein each said dish-shaped part is provided with an inward-facing ridge, and wherein the bearing block includes mounting means for mounting the bearing block on said inward-facing ridge.

8. An electromotively driven sunblind as claimed in claim 7, wherein said mounting means comprises a pair of mounting lips.

9. An electromotively driven sunblind as claimed in claim 8, wherein the screen is of a pleated material.

10. An electromotively driven sunblind as claimed in claim 1, wherein said at least one drive roller is a toothed wheel, and wherein said flexible operating element is a flexible belt with cut-away parts.

11. An electromotively driven sunblind as claimed in claim 10, wherein the flexible belt is endless.

12. An electromotively driven sunblind as claimed in claim 11, wherein two second beams are provided, and wherein both said second beams are connected to the flexible belt.

13. An electromotively driven sunblind as claimed in claim 12, wherein the screen is of a pleated material.

14. An electromotively driven sunblind as claimed in claim 1, wherein the screen is of a pleated material.

* * * * *